US010331058B2

(12) United States Patent
Maeyama

(10) Patent No.: US 10,331,058 B2
(45) Date of Patent: Jun. 25, 2019

(54) IMAGE FORMING APPARATUS CONFIGURED TO DETECT TONER QUALITY

(71) Applicant: Kyocera Document Solutions Inc., Osaka (JP)

(72) Inventor: Keisuke Maeyama, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/965,833

(22) Filed: Apr. 27, 2018

(65) Prior Publication Data

US 2018/0364618 A1 Dec. 20, 2018

(30) Foreign Application Priority Data

Jun. 19, 2017 (JP) ..... 2017-119283

(51) Int. Cl.
*G03G 15/08* (2006.01)
*G03G 15/00* (2006.01)

(52) U.S. Cl.
CPC ..... *G03G 15/0848* (2013.01); *G03G 15/55* (2013.01); *G03G 15/0851* (2013.01); *G03G 15/5016* (2013.01); *G03G 15/6585* (2013.01)

(58) Field of Classification Search
CPC ..... G03G 15/0851; G03G 15/0848
See application file for complete search history.

(56) References Cited

U.S. PATENT DOCUMENTS 4,706,032 A * 11/1987 Allen ..... G03G 15/0851 118/689
5,486,900 A * 1/1996 Wada ..... G03G 15/0848 324/452
5,797,062 A * 8/1998 Wada ..... G03G 15/0848 324/452
7,215,904 B2 * 5/2007 Hasegawa ..... G03G 15/50 399/110
8,106,767 B2 * 1/2012 Okada ..... G03G 15/0855 340/10.4
9,857,730 B2 * 1/2018 Kato ..... G03G 15/086

FOREIGN PATENT DOCUMENTS

JP H09-281786 A 10/1997
JP 2013-020192 A 1/2013
JP 2013205480 A * 10/2013

* cited by examiner

*Primary Examiner* — Clayton E. LaBalle
*Assistant Examiner* — Leon W Rhodes, Jr.
(74) *Attorney, Agent, or Firm* — HEA Law PLLC

(57) ABSTRACT

An image forming apparatus includes a developer unit, a toner container, a capacitance sensor, a toner amount detector, and a determining unit. The toner container is located to be removably attachable to the image forming apparatus. The toner container supplies a toner to the developer unit. The capacitance sensor is located on a supply passage for the toner from the toner container to the developer unit. The capacitance sensor detects an electric charge amount and a relative dielectric constant of the toner. The electric charge amount is an electric charge amount when the toner passes through the supply passage. The toner amount detector detects an amount of the toner passing through the supply passage based on the electric charge amount detected by the capacitance sensor. The determining unit determines whether the relative dielectric constant of the toner detected by the capacitance sensor is in a predetermined range.

7 Claims, 5 Drawing Sheets

IMAGE FORMING APPARATUS CONFIGURED TO DETECT TONER QUALITY

INCORPORATION BY REFERENCE

This application is based upon, and claims the benefit of priority from, corresponding Japanese Patent Application No. 2017-119283 filed in the Japan Patent Office on Jun. 19, 2017, the entire contents of which are incorporated herein by reference.

BACKGROUND

Unless otherwise indicated herein, the description in this section is not prior art to the claims in this application and is not admitted to be prior art by inclusion in this section.

In an image forming apparatus typified by a multi-functional peripheral, a light is irradiated to a photoreceptor to form an electrostatic latent image on the photoreceptor based on image data. Then, a charged toner is supplied on the formed electrostatic latent image to make a visible image, and subsequently, the visible image is transferred to be fixed on a paper sheet and output outside the apparatus.

A typical image forming apparatus includes a developing device that uses a developer such as a toner to perform development. The developing device rotates a developer by a rotator or similar unit to charge the developer, and electrically attaches the developer on an electrostatic latent image, thus executing the development. The developing device is appropriately supplied with the toner consumed by the development by a toner container removably attachable to the image forming apparatus. A technique regarding toner supply has been proposed.

There has been proposed an image forming apparatus that includes a toner container, a developing unit, a magnetic flow rate sensor, and a controller. The developing unit is replenished with a toner from the toner container. The magnetic flow rate sensor measures a replenishment amount of the toner replenished from the toner container to the developing unit. The controller controls the toner replenishment from the toner container to the developing unit based on the toner replenishment amount measured by the magnetic flow rate sensor.

The following toner end detector included in an electrophotographic apparatus has been proposed. This toner end detector includes a toner housing chamber, an agitator, and a toner sensor. The toner housing chamber houses a toner. The agitator is rotationally driven in this toner housing chamber, and replenishes the toner in this toner housing chamber to the developing unit. The toner sensor is installed in the toner housing chamber, and detects a thickness of the toner in this toner housing chamber. The toner end detector uses an analog output voltage of this toner sensor that varies in accordance with the rotation of the agitator in the toner housing chamber, thus detecting the toner end based on the variation of this analog output voltage.

SUMMARY

An image forming apparatus according to one aspect of the disclosure forms image. The image forming apparatus includes a developer unit, a toner container, a capacitance sensor, a toner amount detector, and a determining unit. The developer unit forms a toner image. The toner container is located to be removably attachable to the image forming apparatus. The toner container supplies a toner to the developer unit. The capacitance sensor is located on a supply passage for the toner from the toner container to the developer unit. The capacitance sensor detects an electric charge amount and a relative dielectric constant of the toner. The electric charge amount is an electric charge amount when the toner passes through the supply passage. The toner amount detector detects an amount of the toner passing through the supply passage based on the electric charge amount detected by the capacitance sensor. The determining unit determines whether the relative dielectric constant of the toner detected by the capacitance sensor is in a predetermined range.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
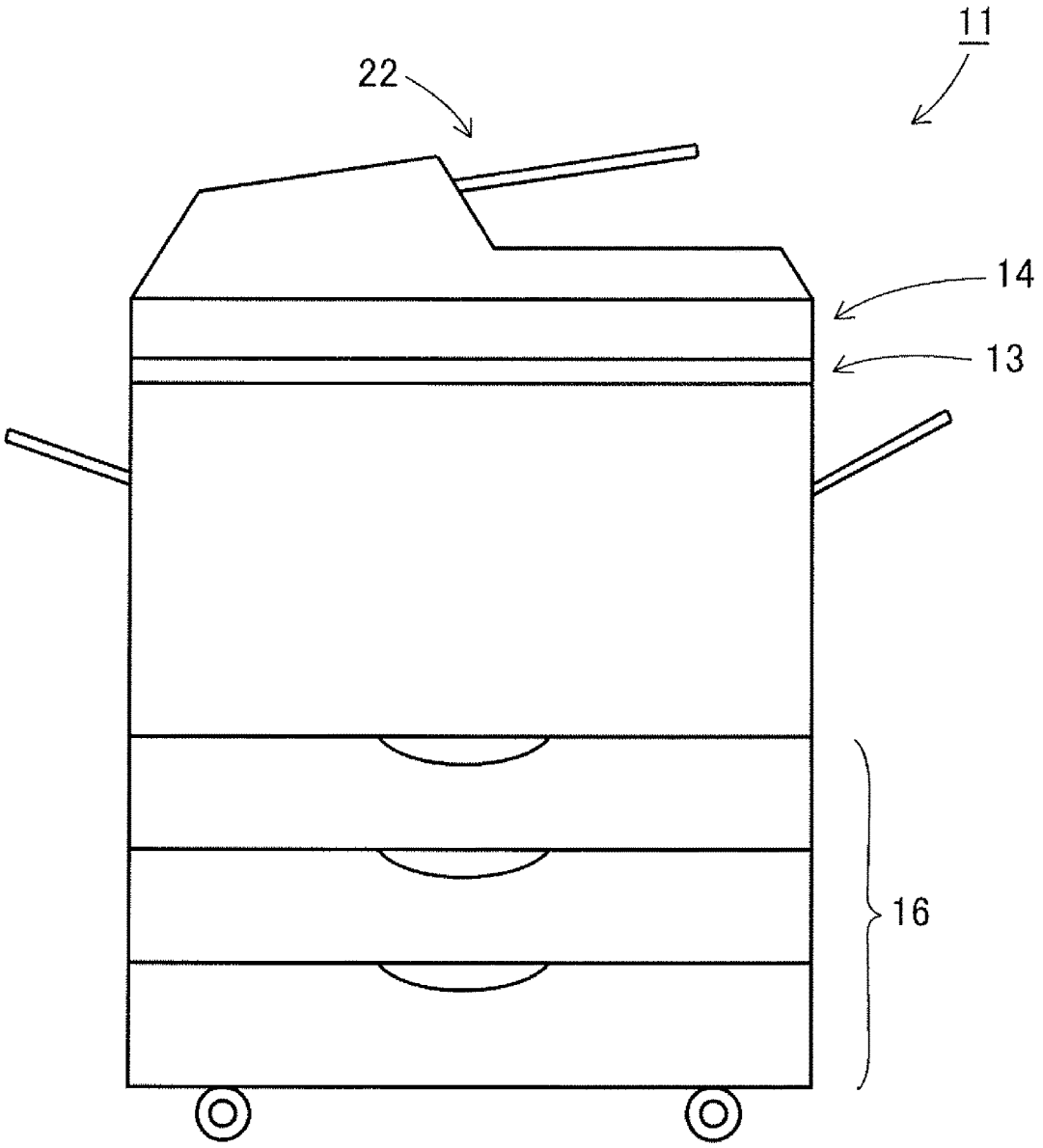
FIG. 1 schematically illustrates an external appearance of a multi-functional peripheral when an image forming apparatus according to one embodiment of the disclosure is applied to the multi-functional peripheral.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Figure 2:
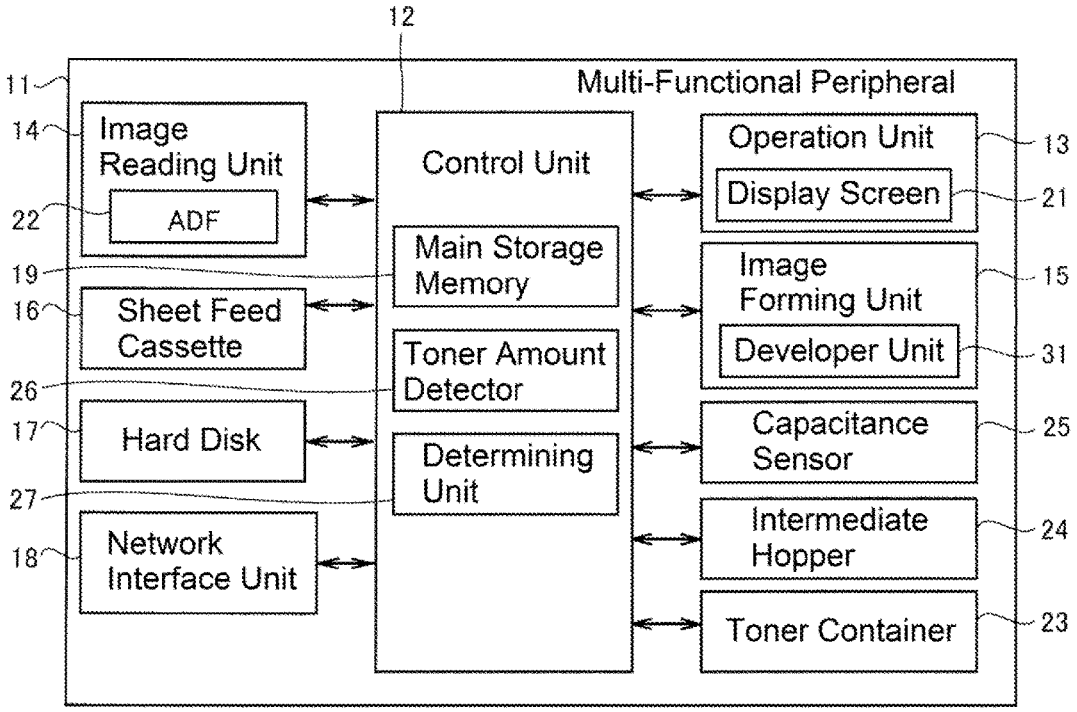
FIG. 2 illustrates a configuration of the multi-functional peripheral according to the one embodiment.

The following describes embodiments of the disclosure. FIG. 1 schematically illustrates an external appearance of a multi-functional peripheral 11 when an image forming apparatus according to one embodiment of the disclosure is applied to the multi-functional peripheral. FIG. 2 is a block diagram illustrating a configuration of the multi-functional peripheral 11 illustrated in FIG. 1. In the following drawings, like reference numerals are designated to the configuration similar to or corresponding to those in FIGS. 1 and 2, and their descriptions will not be further elaborated here.

With reference to FIGS. 1 and 2, the multi-functional peripheral 11 includes a control unit 12, an operation unit 13, an image reading unit 14, an image forming unit 15, a sheet feed cassette 16, a hard disk 17 as a storage unit, a network interface unit 18, a toner container 23, an intermediate hopper 24, and a capacitance sensor 25. The network interface unit 18 is connected to a network. The toner container 23 includes a toner supply roller and similar unit. The intermediate hopper 24 temporarily stores toners in the multi-functional peripheral 11.

The control unit 12 controls the entire multi-functional peripheral 11. The control unit 12 is constituted of a central processing unit (CPU) and similar unit, and includes a main storage memory 19 that temporarily stores data. The operation unit 13 includes a display screen 21 as a touch panel type display that displays information transmitted from the multi-functional peripheral 11 side and contents input by a user. The operation unit 13 accepts inputs from the user relating to the image formation including conditions on an image formation such as the number of print copies and a tone. The image reading unit 14 includes an auto-document feeder (ADF) 22 as a document feeder that feeds a document set on a set position to a reading position. The image reading unit 14 reads an image of the document set on the ADF 22 or a placement table. Three sheet feed cassettes 16 are located to each internally house a plurality of paper sheets. The image forming unit 15 forms the image on the paper sheet fed from any of the sheet feed cassettes 16 based on image data of the document read by the image reading unit 14 and image data transmitted via the network. The hard disk 17 stores data on the image formation such as the transmitted image data, the input image formation condition, and similar data.

Figure 3:
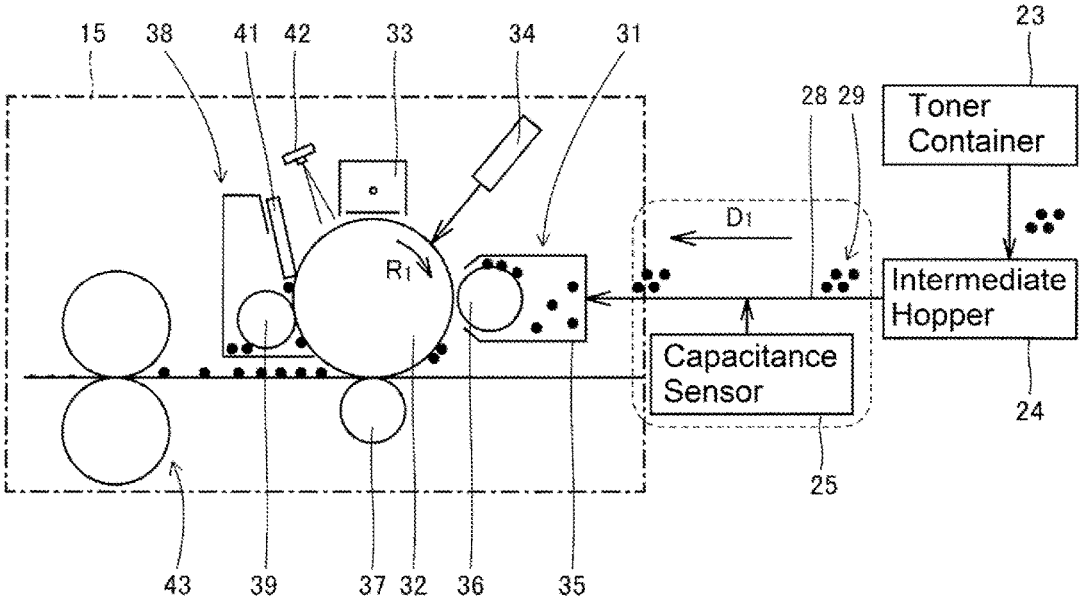
FIG. 3 illustrates a configuration of a periphery of an image forming unit.

Next, a configuration of a periphery of the image forming unit 15 will be described. FIG. 3 illustrates the configuration of the periphery of the image forming unit 15. With reference to FIG. 3, the image forming unit 15 includes a photoreceptor 32, a charger 33, an exposure device 34, a developer unit 31, a transfer unit 37, a cleaning unit 38, a destaticizing lamp 42, and a fixing unit 43. The charger 33 charges the photoreceptor 32. The exposure device 34 exposes a surface of the photoreceptor 32 based on the image data. The developer unit 31 supplies a toner 29 to the surface of the photoreceptor 32. The transfer unit 37 transfers a toner image formed on the photoreceptor 32 to the paper sheet side. The cleaning unit 38 performs a cleaning by removing the toner 29 remaining on the photoreceptor 32 and similar cleaning after the transferring to the paper sheet. The destaticizing lamp 42 removes the electric charge remaining on the photoreceptor 32. The fixing unit 43 includes a pair of fixing rollers and fixes the toner image on the paper sheet.

The photoreceptor 32 rotates in a direction indicated by an arrow $R_1$ in FIG. 3. A supply direction of the toner 29 and a conveyance direction of the paper sheet onto which the toner image is transferred are indicated by an arrow $D_1$. The charger 33 charges the photoreceptor 32. Then, the exposure device 34 exposes the surface of the photoreceptor 32 based on the image data read by the image reading unit 14 and similar data. Thus, an electrostatic latent image is formed on the surface of the photoreceptor 32. The developer unit 31 includes a developing container 35 that houses the toner 29, and a developing roller 36 that rotates to charge the toner 29 and supplies the toner 29 to the photoreceptor 32. The toner 29 charged by the developer unit 31 is supplied to the surface of the photoreceptor 32, thus forming a visible image by the toner, namely the toner image on the surface of the photoreceptor 32. The formed toner image is transferred to the paper sheet side by the transfer unit 37. The paper sheet onto which the toner image is transferred is fed to the fixing unit 43 side, and the fixing unit 43 fixes the toner image on the paper sheet. The cleaning unit 38 includes a cleaning roller 39 and a cleaning blade 41. The cleaning roller 39 rotates to remove the toner 29 remaining on the photoreceptor 32. The cleaning blade 41 is made of rubber and plate-shaped, and abuts on the surface of the photoreceptor 32. The toner 29 remaining on the photoreceptor 32 without being transferred to the paper sheet side by the transfer unit 37 is removed by the cleaning roller 39 and the cleaning blade 41. The electric charge remaining on the photoreceptor 32 is removed by the destaticizing lamp 42.

In the developer unit 31, a development, that is, a supply of the toner 29 to the photoreceptor 32 side, consumes the toner 29 in the developing container 35. The toner 29 is supplied to the developing container 35 by the consumed amount. The toner container 23 is filled with the toner 29 to be supplied to the developer unit 31. The toner 29 is supplied to the developing container 35 from the toner container 23 via the intermediate hopper 24 passing through a supply passage 28 through which the toner 29 passes. That is, the toner container 23 supplies the toner 29 to the developer unit 31. The toner container 23 is located to be removably attachable to the multi-functional peripheral 11.

The toner container 23 is filled with a genuine toner, namely the toner 29 provided by a developer of the multi-functional peripheral 11 as the toner 29 appropriate to the multi-functional peripheral 11. On such a toner 29, the developer and similar person of the multi-functional peripheral 11 preliminarily measure a relative dielectric constant of the toner 29. However, among the commercially available toner containers 23 for replacement, there is a toner container 23 filled with a non-genuine toner, namely a toner not provided by the developer of the multi-functional peripheral 11 but having different components while the components are similar to the genuine toner. Such a non-genuine toner does not assure image quality, and continuous use of the non-genuine toner possibly adversely affects the multi-functional peripheral 11.

The capacitance sensor 25 is located on the supply passage 28 for the toner 29 from the toner container 23 to the developer unit 31, specifically, the developing container 35 included in the developer unit 31. The capacitance sensor 25 detects an electric charge amount when the toner 29 passes through the supply passage 28 and the relative dielectric constant of the toner 29.

Here, a configuration of the control unit 12 will be described. With reference to FIG. 2 again, the control unit 12 includes a toner amount detector 26 and a determining unit 27. The toner amount detector 26 detects an amount of the toner 29 passing through the supply passage 28 based on the electric charge amount detected by the capacitance sensor 25. The determining unit 27 determines whether or not the relative dielectric constant of the toner 29 detected by the capacitance sensor 25 is within a predetermined range. Specifically, the determining unit 27 determines whether or not the relative dielectric constant of the toner 29 detected by the capacitance sensor 25 is equal to or more than a first value as an upper-limit value of the set predetermined range, and whether or not equal to or less than a lower-limit value of the set predetermined range.

Figure 4:
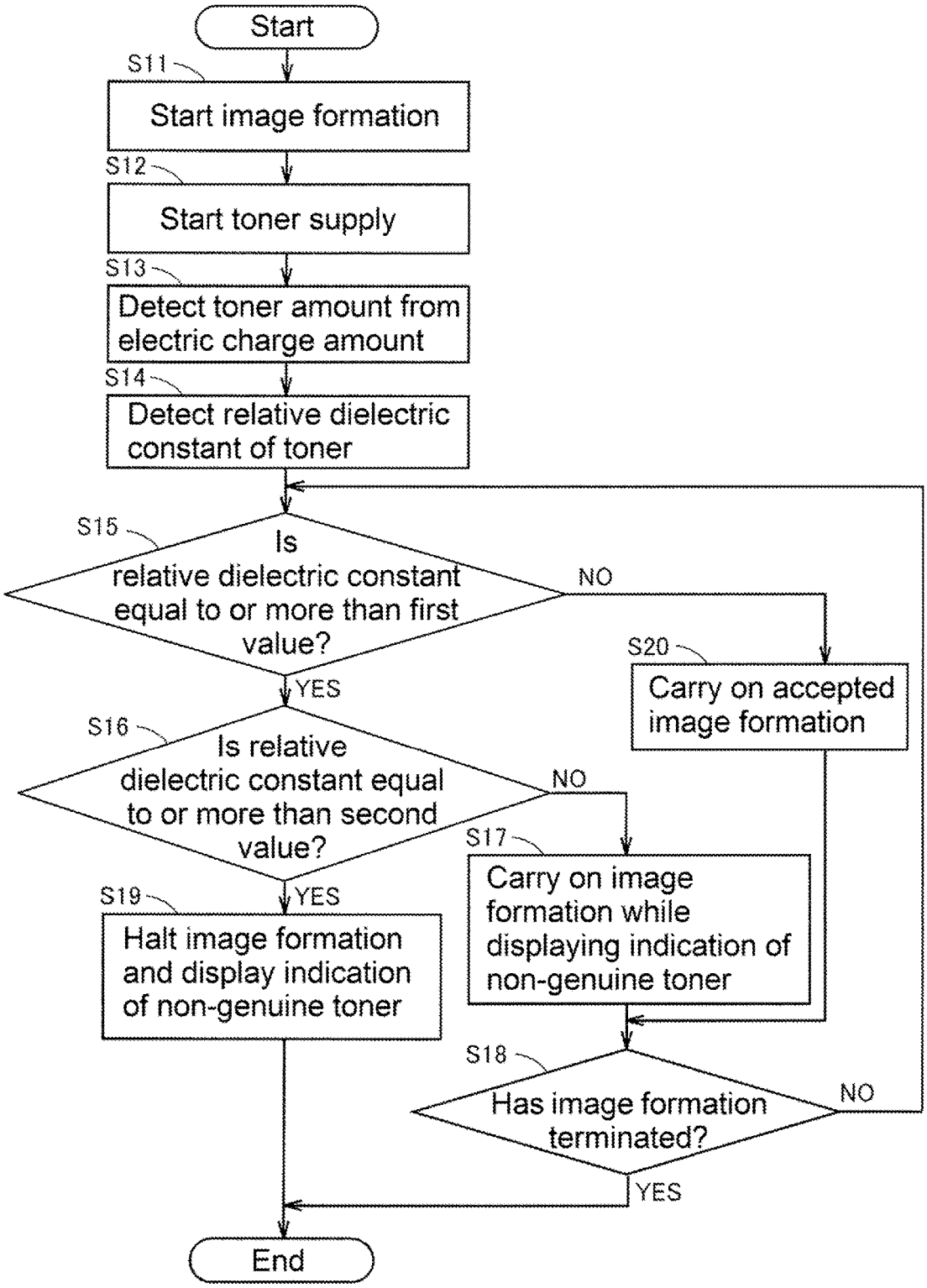
FIG. 4 illustrates an operation when an image is formed in the multi-functional peripheral.

Next, an image formation in the multi-functional peripheral 11 will be described. FIG. 4 illustrates an operation when an image is formed in the multi-functional peripheral 11. With reference to FIG. 4, when a request for an image formation from the user to the operation unit 13 is accepted, and then the image formation starts (in FIG. 4, Step S11, hereinafter "Step" will be omitted), the toner 29 is gradually consumed. Then, the supply of the toner 29 starts by the amount of the consumed toner 29 (S12). That is, the toner 29 is replenished in the developing container 35 from the toner container 23 via the intermediate hopper 24 passing through the supply passage 28. Here, the toner amount detector 26 uses the capacitance sensor 25 to detect the electric charge amount, and detects the toner amount (S13). The capacitance sensor 25 detects the relative dielectric constant of the toner 29 (S14). The determining unit 27 determines whether or not the relative dielectric constant of the toner 29 detected by the capacitance sensor 25 is in the predetermined range. Specifically the determining unit 27 determines whether or not the relative dielectric constant of the toner 29 is equal to or more than the first value and whether or not the relative dielectric constant of the toner 29 is equal to or less than a lower-limit value of the predetermined range (S15).

Figure 5:
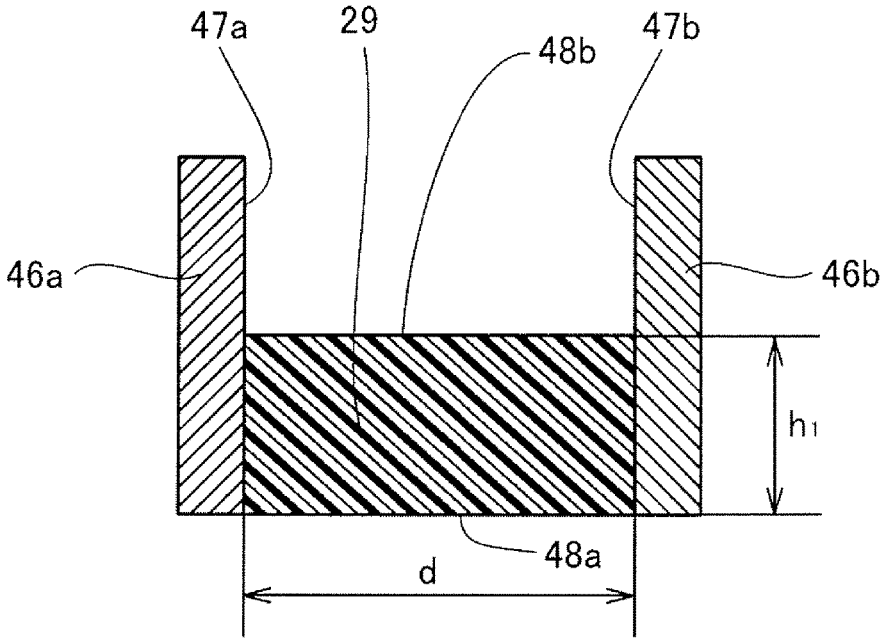
FIG. 5 illustrates a cross section of a part of a configuration of a capacitance sensor.
Figure 6:
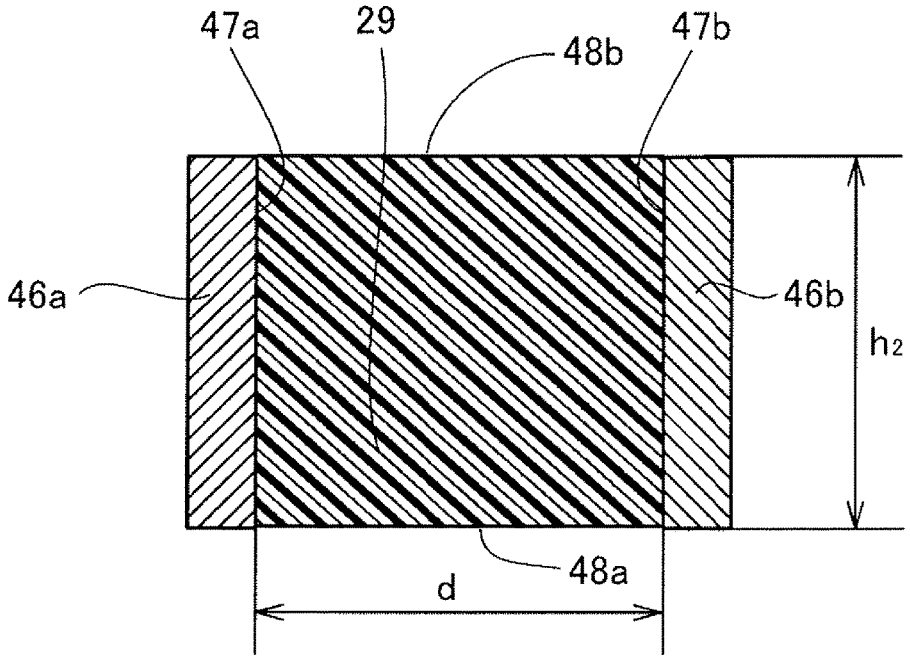
FIG. 6 illustrates a cross section of a part of the configuration of the capacitance sensor.

Here, a description will be given of the detection of the relative dielectric constant of the toner 29 by the capacitance sensor 25. FIGS. 5 and 6 are cross sections of a part of a configuration of the capacitance sensor 25. With reference to FIGS. 5 and 6, the capacitance sensor 25 includes a pair of electrodes 46*a* and 46*b*. The electrode 46*a* on a positive side and the electrode 46*b* on a negative side are located across a distance d. The distance d is a distance between facing surfaces 47*a* and 47*b* of the electrodes 46*a* and 46*b* respectively. That is, in this configuration, the relative dielectric constant of the toner 29 is detected when the toner 29 passes between the pair of the electrodes 46*a* and 46*b* at a part of the supply passage 28. FIG. 5 illustrates a state where the toner 29 is included between the electrodes 46*a* and 46*b* by 50%. FIG. 6 illustrates a state where the toner 29 is included between the electrodes 46*a* and 46*b* by 100%.

In the capacitance sensor 25, the electric charge amount varies corresponding to a height $h_1$ from a bottom surface 48*a* to a top surface 48*b* of the loaded toner 29, and the toner amount is detected based on the varying electric charge amount. Then, the replenishment amount of the toner 29 is calculated by, for example, integrating the supplied toner amount based on the detection result of the toner amount. The height $h_1$ is a height as 50% of an entire height of the electrode 46*a* and 46*b*. A height $h_2$ is a height as 100% of the entire height of the electrode 46*a* and 46*b*. Since respective areas of the surfaces 47*a* and 47*b* of the electrodes 46*a* and 46*b* and the distance d are constant, the relative dielectric constant of the toner 29 included between the electrodes 46*a* and 46*b* is detected corresponding to the heights $h_1$ and $h_2$ from the bottom surface 48*a* to the top surface 48*b* of the loaded toner 29.

Here, assume that the relative dielectric constant of the genuine toner is three, the relative dielectric constant of a first non-genuine toner $B_1$ is five, the relative dielectric constant of a second non-genuine toner $B_2$ different from the first non-genuine toner $B_1$ is two, and the relative dielectric constant of atmosphere is one. Then, based on a value of the electric charge amount detected by the capacitance sensor 25, the relative dielectric constant of the toner 29 is detected as follows. Note that: Q=CV (Q: electric charge amount (C), C: capacitance (F), V: inter-electrode voltage (V)), and $C=\varepsilon_r \cdot \varepsilon 0 \cdot S/d$ ($\varepsilon_r$: relative dielectric constant, $\varepsilon_0$: dielectric constant ($Fm^{-1}$), S: electrode size ($m^2$), d: inter-electrode distance (m)). The relative dielectric constant of the toner 29 is detected using the equations. The person who has developed the multi-functional peripheral 11 and provided the toner container 23 to the market is a person who knows the relative dielectric constant of the genuine toner. The above-described predetermined range can be a range configured considering a detection error added to 3 as the relative dielectric constant of the genuine toner, for example, a range of 2.5 to 3.5.

As illustrated in FIG. 5, when the toner amount between the electrodes is 50%, the toner 29 including only the genuine toner provides the relative dielectric constant between the electrodes as $3\times0.5+1\times0.5=2$. The toner 29 including only the non-genuine toner $B_1$ provides the relative dielectric constant between the electrodes as $5\times0.5+1\times0.5=3$. The toner 29 including only the non-genuine toner $B_2$ provides the relative dielectric constant between the electrodes as $2\times0.5+1\times0.5=1.5$. As illustrated in FIG. 6, when the toner amount between the electrodes is 100%, the toner 29 including only the genuine toner provides the relative dielectric constant between the electrodes as $3\times1+1\times0=3$. The toner 29 including only the non-genuine toner $B_1$ provides the relative dielectric constant between the electrodes as $5\times1+1\times0=5$. The toner 29 including only the non-genuine toner $B_2$ provides the relative dielectric constant between the electrodes as $2\times1+1\times0=2$. That is, when the non-genuine toner $B_1$ or the non-genuine toner $B_2$ is filled to the toner container 23 while the toner amount is 100%, the above-described values such as five as the relative dielectric constant and two as the relative dielectric constant are detected.

Here, assume that the toner amount is 100%. When the toner amount is 100% including the genuine toner by 75% and the non-genuine toner $B_1$ mixed by 25%, the relative dielectric constant is $3\times0.75+5\times0.25=3.5$. At this time, when the first value is set to 3.5, the determining unit 27 determines the relative dielectric constant of the toner 29 to be equal to or more than the first value (YES at S15). That is, when the relative dielectric constant of the toner 29 detected by the capacitance sensor 25 is equal to or more than the first value, the determining unit 27 determines that the non-genuine toner is mixed, not the detection error of the relative dielectric constant. The first value is a value on a level where the image formation is carried on while the mixture of the non-genuine toner is displayed for notification. For this determination, when the toner container 23 in which the genuine toner is filled is used at first, and the toner container 23 in which the non-genuine toner is filled is used from the middle of printing, the relative dielectric constant of the toner 29 gradually varies. That is, for example, when a few minutes or more has elapsed after the start of continuous printing by the multi-functional peripheral 11, the relative dielectric constant of the toner 29 becomes outside of the predetermined range.

Then, the determining unit 27 determines whether or not the detected relative dielectric constant of the toner 29 is equal to or more than a second value higher than the first value (S16). The second value is a value on a level where the image formation by the multi-functional peripheral 11 is to be promptly halted due to a considerably high content ratio of the non-genuine toner. When the second value is set to four, the determining unit 27 determines the relative dielectric constant of the toner 29 not to be equal to or more than the second value (NO at S16). Then, the display screen 21 displays an indication of the non-genuine toner while the image formation is performed (S17). This process is performed until the image formation terminates (S18). The value four set as the second value corresponds to a case where the genuine toner is 50% and the non-genuine toner $B_1$ is mixed by 50%.

Figure 7:
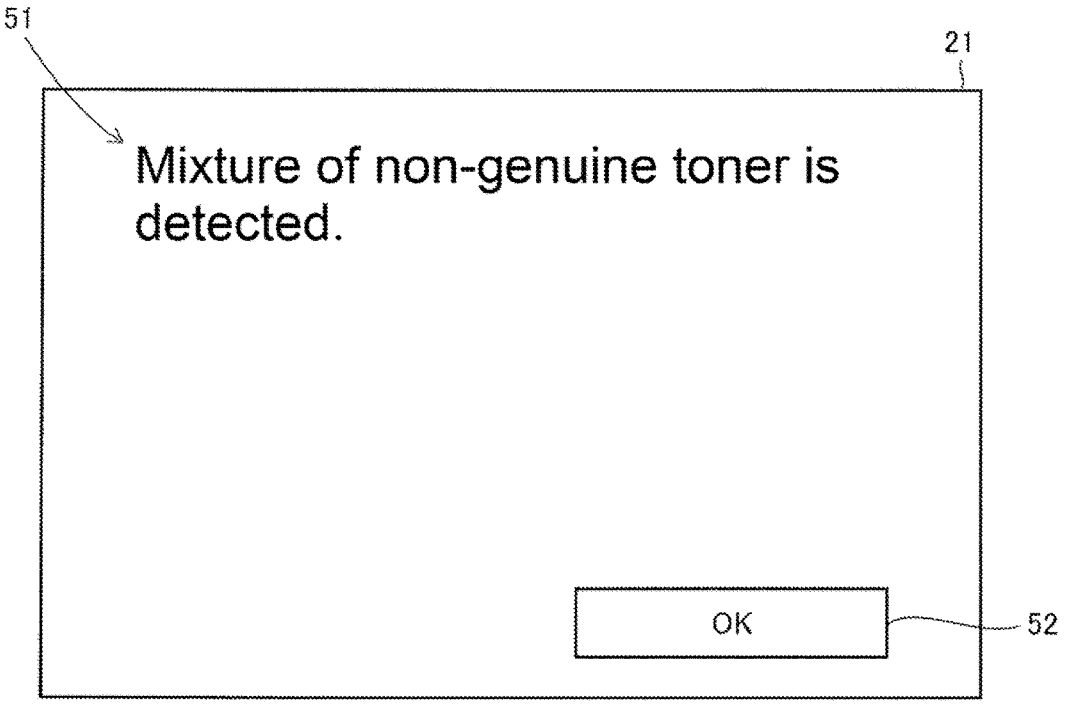
FIG. 7 illustrates an exemplary display screen displaying an indication of a non-genuine toner.

FIG. 7 illustrates an exemplary display screen 21 displaying the indication of the non-genuine toner. With reference to FIG. 7, the display screen 21 displays the character string 51, "Mixture of non-genuine toner is detected." and also "OK," and displays a selection key 52 that detects a press to cause the display screen 21 to transition to the other screen. The containing of the non-genuine toner $B_1$ in the toner 29 is thus notified.

On the other hand, at S16, when the relative dielectric constant of the toner 29 is equal to or more than the second value (YES at S16), the determining unit 27 aborts the image formation. That is, the operation of the image formation is halted. The display screen 21 displays an indication of the mixture of the non-genuine toner $B_1$ and prompting the change of the toner container 23 (S19). In this case, for example, on the display screen 21 illustrated in FIG. 7, a character string of "This toner container is not supported. Please change to the supported one." is displayed instead of the character string 51.

At S15, when the detected relative dielectric constant is less than the first value (NO at S15), the accepted image formation is carried on until the image formation terminates, and the electric charge amount and the relative dielectric constant of the toner 29 are monitored (S20, S18).

According to the multi-functional peripheral 11 having such a configuration, the capacitance sensor 25 detects the electric charge amount to detect the toner amount. This ensures using the toner amount for calculating a toner replenishment amount based on the detection result. The determining unit 27 determines whether or not the detected relative dielectric constant of the toner is in the predetermined range. This ensures reflecting the determination result on the image formation. Accordingly, the influence of the mixture of the non-genuine toner on the image formation can be reduced. In this case, the above-described configuration of the multi-functional peripheral 11 including the capacitance sensor 25 and similar unit eliminates the need for locating the above-described sensor to each toner container 23 removably attachable to the multi-functional peripheral 11. As a result, this multi-functional peripheral 11 can maintain the satisfactory image formation with an inexpensive configuration.

Since such a capacitance sensor 25 can perform the detection without contacting the toner 29, there is no restriction on the installation position different from a pressure sensor and similar sensor required to be located to each of the toner containers 23 for detecting unexpected opening. In this case, contamination of the capacitance sensor 25 by the toner 29 can be prevented, thus preventing the degradation of the detection accuracy. Furthermore, the detection of the toner itself ensures dealing with a case where a mechanism for determining the genuine toner and the non-genuine toner is not located to the toner container 23.

In this case, the determining unit 27 determines whether or not the relative dielectric constant of the toner 29 is equal to or more than the first value. Then, when the determining unit 27 has determined that the relative dielectric constant of the toner 29 is equal to or more than the first value, the display screen 21 displays the indication that the non-genuine toner is mixed. Accordingly, whether or not the non-genuine toner is mixed can be more appropriately visually grasped.

In this case, when the relative dielectric constant of the toner 29 is determined to be equal to or more than the second value, the determining unit 27 performs the control so as to halt the operation of the image formation. This ensures halting the operation of the image formation to prevent the operational failure and the damage of the multi-functional peripheral 11 when the content ratio of the non-genuine toner is high and the influence on the multi-functional peripheral 11 is large, for example, the multi-functional peripheral 11 possibly causes the operational failure. When the determining unit 27 determines that the relative dielectric constant of the toner 29 is equal to or more than the second value, the display screen 21 display the indication prompting the change of the toner container 23, thus prompting the use of the genuine toner to ensure preventing the damage of the multi-functional peripheral 11 and maintaining the high image quality.

In this case, the configuration including the display screen 21 that displays the determination result by the determining unit 27 ensures visually clearly notifying the determination result, for example, whether the non-genuine toner is mixed, to the outside.

Figure 8:
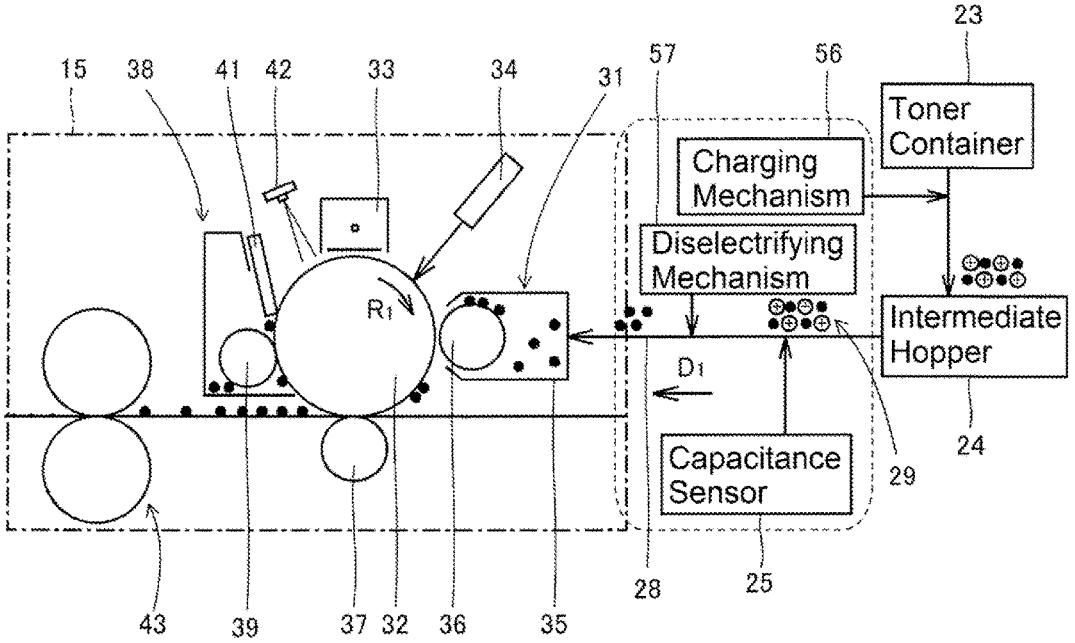
FIG. 8 illustrates a periphery of an image forming unit included in a multi-functional peripheral according to another embodiment of the disclosure.

The following configuration may be employed. FIG. 8 illustrates a periphery of an image forming unit 15 included in a multi-functional peripheral according to another embodiment of the disclosure. With reference to FIG. 8, the multi-functional peripheral is configured to include a charging mechanism 56 and a diselectrifying mechanism 57. On the periphery of the image forming unit 15 included in the multi-functional peripheral, the charging mechanism 56 that charges the toner supplied from the toner container 23 is located on an upstream side with respect to the capacitance sensor 25 in a toner supply direction on the supply passage 28, and the diselectrifying mechanism 57 that diselectrifies the toner is located on a downstream side with respect to the capacitance sensor 25 in the toner supply direction on the supply passage 28.

This configuration ensures the detection of the relative dielectric constant after sufficiently charging the toner by the charging mechanism 56 even when the difference in the relative dielectric constant is small between the genuine toner and the non-genuine toner. Accordingly, whether or not the non-genuine toner is included can be determined with more certainty. In this case, the diselectrifying mechanism 57 performs the diselectrifying before the toner is supplied to the developing container 35, thus not giving the influence on the image quality.

In the charging mechanism 56, for example, a plate-shaped blade may be used to rub the toner so as to charge the toner. For example, friction between the blade and a toner replenishment roller of the toner container 23 is used to charge the toner 29. This ensures charging the toner with more physical certainty. For the toner 29 charged by the charging mechanism 56, when the charging amount of the toner 29 is controllable or small, the toner 29 may be supplied to the developing container 35 as it is without especially performing the diselectrifying.

In the above-described embodiment, the first value and the second value are appropriately determined corresponding to a destination, a user, and similar factor. That is, a control where the image formation is halted even when the content ratio of the non-genuine toner is about 10% may be performed. The level of the notification of the fact that the non-genuine toner is mixed may be differed corresponding to the content ratio. For example, when the content ratio of the non-genuine toner reaches a third value between the first value and the second value, the display screen 21 may display "This toner is not supported." while the image formation is continued. A configuration where the detection accuracy of the capacitance sensor 25 is adjustable by the control by the control unit 12 may be employed.

While the display screen 21 displays the determination result in the above-described embodiment, not limiting to this, the determination result by the determining unit 27 may be notified by audio. The determination result may be notified by audio with display.

While the determining unit 27 determines whether or not the relative dielectric constant of the toner 29 is equal to or more than the first value and the second value in the above-described embodiment, not limiting to this, the determining unit 27 may determine whether or not the relative dielectric constant of the toner 29 is in a predetermined range. This ensures the determination of the mixture of the non-genuine toner even when a non-genuine toner having a low relative dielectric constant is mixed, thus dealing with the image formation and similar operation.

In the above-described embodiment, the capacitance sensor 25 may be located to be removably attachable to the multi-functional peripheral 11. This ensures installing the capacitance sensor 25 to the multi-functional peripheral 11 corresponding to the condition of using the multi-functional peripheral 11 so as to determine whether or not the non-genuine toner is included.

In the above-described embodiment, the multi-functional peripheral 11 is not necessary to include the intermediate hopper 24. The capacitance sensor 25 may be located at the intermediate hopper 24 as a part of the supply passage 28 for the toner 29.

The capacitance sensor 25 may additionally include a height measurement sensor that measures a height of the toner 29. This ensures the measurement of the height of the toner 29 by the height measurement sensor. The capacitance sensor 25 may be configured to contact the toner 29 to detect the relative dielectric constant of the toner 29.

The image forming apparatus according to the disclosure is especially effectively used when maintaining the satisfactory image formation is required with the inexpensive configuration.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus for forming image, comprising:

a developer unit that forms a toner image;

a toner container located to be removably attachable to the image forming apparatus, the toner container supplying a toner to the developer unit;

a capacitance sensor located on a supply passage for the toner from the toner container to the developer unit, the capacitance sensor detecting an electric charge amount and a relative dielectric constant of the toner, the electric charge amount being an electric charge amount when the toner passes through the supply passage;

a toner amount detector that detects an amount of the toner passing through the supply passage based on the electric charge amount detected by the capacitance sensor; and a determining unit that determines whether the relative dielectric constant of the toner detected by the capacitance sensor is in a predetermined range.

2. The image forming apparatus according to claim 1, further comprising a display that displays an indication that the toner includes a non-genuine toner when the determining unit determines that the relative dielectric constant of the toner is out of the predetermined range.

3. The image forming apparatus according to claim 1, wherein the determining unit controls to halt an operation of an image formation when the relative dielectric constant of the toner is determined to be equal to or more than a second value, the second value is greater than a first value as an upper-limit value of the predetermined range.

4. The image forming apparatus according to claim 3, wherein the display displays an indication prompting a change of the toner container when the determining unit determines that the relative dielectric constant of the toner is equal to or more than the second value.

5. The image forming apparatus according to claim 1, further comprising:

a charging mechanism located on an upstream side with respect to the capacitance sensor in a toner supply direction on the supply passage, the charging mechanism charging the toner supplied from the toner container; and a diselectrifying mechanism located on a downstream side with respect to the capacitance sensor in the toner supply direction on the supply passage, the diselectrifying mechanism diselectrifies the toner charged by the charging mechanism.

6. The image forming apparatus according to claim 1, wherein the capacitance sensor detects the relative dielectric constant of the toner without contacting the toner.

7. The image forming apparatus according to claim 1, wherein the capacitance sensor is located to be removably attachable to the image forming apparatus.

* * * * *